United States Patent [19]

Muise et al.

[11] Patent Number: 4,572,424

[45] Date of Patent: Feb. 25, 1986

[54] BLANK FOR A PAIR OF NESTED CONTAINERS

[75] Inventors: Herbert D. Muise, Orange; R. Scott Hunter, San Jose, both of Calif.

[73] Assignee: Weyerhaeuser Company, Tacoma, Wash.

[21] Appl. No.: 592,059

[22] Filed: Mar. 22, 1984

[51] Int. Cl.[4] ..... B65D 5/10

[52] U.S. Cl. ..... 229/39 R; 229/DIG. 9; 229/44 R

[58] Field of Search ..... 229/DIG. 9, 38, 39 R, 229/43, 44 R

[56] References Cited

U.S. PATENT DOCUMENTS

| | | | |
|---|---|---|---|
| 2,513,079 | 6/1950 | Buerger | 229/41 |
| 3,285,492 | 11/1966 | Demby et al. | 229/23 |
| 3,539,093 | 11/1970 | Massengill | 229/DIG. 9 |
| 3,679,124 | 7/1972 | Schillinger | 229/51 |
| 3,960,313 | 6/1976 | Sax et al. | 229/41 |
| 4,003,516 | 1/1977 | Commerford et al. | 229/DIG. 9 |
| 4,007,869 | 2/1977 | Stolkin et al. | 229/41 |
| 4,072,263 | 2/1978 | Focke | 229/DIG. 9 |

FOREIGN PATENT DOCUMENTS 859905 1/1961 United Kingdom .

*Primary Examiner*—Joseph Man-Fu Moy

[57] ABSTRACT

A container which is nested along its bottom closure panels in the web to gain additional capacity in a waxing unit. There are oblique outer edges on each of the bottom closure panels which allow the panels to be nested in the blank. All of oblique outer edges of each of the bottom closure panels extend in the same direction creating long and short sections in each of the closure panels which in the finished container interlock to hold the closure panels in a locked position. The oblique edges also provide camming edges which allow the bottom closure panels to be pushed inwardly into the container until they interlock and then snap back into position to form the bottom closure.

15 Claims, 14 Drawing Figures

23a
37a
20a
24a
60a
25a
25
61b
25b
24b
20b
37b
23b
29a
21a
38a
22a
33a
34a
26a
30a
39a
35a
27a
31a
40a
36a
28a
32a
41a
29b
21b
38b
22b
33b
34b
26b
30b
39b
35b
27b
31b
40b
36b
28b
32b
41b
42
43
44
45
46
47
48
49
49a
49b
50
50a
50b
51
51a
51b
52
52a
52b
53
54
55
56
57
58
59
61a
62a
62b
63a
63b
64a
64b
65a
65b
66a
66b
67a
67b
68a
68b
69a
69b
70a
70b
71a
71b
72a
72b
73a
73b
74a
74b
75a
75b

BLANK FOR A PAIR OF NESTED CONTAINERS

BACKGROUND OF THE INVENTION

Many containers used with produce or meat are wax coated or wax impregnated. This allows the meat or produce to be iced during storage and transportation. The containers are wax coated or wax impregnated either by passing the individual container blanks through a molten wax bath or by carrying the individual container blanks through a hood in which the molten wax is sprayed or cascaded onto the blank. These wax applications are slow because the containers must be completely saturated with the molten wax and the molten wax cooled before the container leaves the process. The containers can then be stacked and bundled without adhering to each other. Because the process is slow and time constrained and because the apparatus has a fixed dimension, the number of container blanks which may be wax saturated during any given time period is limited by the size of the apparatus.

The containers often are required on a seasonal basis and it usually is desirable to have high and low production periods depending on when the containers are needed. This is not possible normally because only a fixed number of blanks can be treated in a given time period. It is then necessary either to have continuous production throughout the year and carry inventory, to run additional shifts in order to obtain the desired number of wax saturated containers when they are needed or to have an oversized apparatus.

These containers often are used in locations such as a produce field where it is difficult to tape or glue the bottom closure panels. For this reason regular slotted containers (RSC) which normally are stitched or glued are not used. A regular slotted container with a snap lock bottom closure is used instead.

Buerger, U.S. Pat. No. 2,513,079 granted June 27, 1950; Sax, et al, U.S. Pat. No. 3,960,313 granted June 1, 1976 and Stolkin, et al, U.S. Pat. No. 4,007,869 granted Feb. 15, 1977 show snap lock bottom closures. The Buerger patent is exemplary. In this patent the fold-back flaps 42 and 43 are adhered to their adjacent flaps and when the container is squared the bottom closure snaps into place. The snap lock bottom requires additional fold-back and adhering operations in its manufacture.

The snap lock bottom type constructions require spot gluing with specific placement of the adhesive if the container is to function properly. The snap lock bottom also requires nonrectangular adhesive patterns. In a wax saturated container the adhesive must be of a special type in order to fasten to the fibers in the containerboard.

The Buerger patent also discloses the nesting of the top closure panels on the web. Other patents which describe nesting of blanks on a web are FIGS. 8–10 of Schillinger, U.S. Pat. No. 3,679,124 granted July 25, 1972; Demby, et al, U.S. Pat. No. 3,285,492 granted Nov. 15, 1966; and British Pat. No. 859,905 published Jan. 25, 1961.

SUMMARY OF THE INVENTION

The inventors were presented with a two-fold problem. It was necessary to provide a container which could be sent to a produce field in a flat condition and be set up by hand in the field. It was also necessary to keep the number of manufacturing operations to a minimum. A container having a bottom closure which did not require a gluing operation in the manufacturing plant and did not require glue, stapling or taping in the field would be preferred.

They were able to provide within this design limitation a bottom closure configuration which allowed the containers to be erected and the bottom closures locked by hand in the field.

This was done by providing oblique outer edges on each of the bottom closure panels. All of the oblique outer edges of each of the bottom closure panels extend in the same direction. This creates long and short sections in each of the closure panels which in the finished container interlock to hold the closure panels in locked position. The oblique edges also provide camming edges which allow the bottom closure panels to be pushed inwardly into the container until they interlock and then snap back into position to form the bottom closure.

This provides a container which is easily set up and has bottom closure panels which are easily interlocked. The container has the ease of setup of a snap lock bottom but does not have the problems associated with the snap lock container. There is no need of pattern gluing or additional manufacturing steps to form a snap lock bottom.

This design created the second problem. The interlocking feature on the bottom closure panels caused these panels to be longer from their hinge line to their outer edge than normal bottom closure panels and an individual container blank to take more room in the waxing facility, decreasing production. The second problem was how to bring the capacity of the waxing facility back to normal.

They were able to accomplish this by reversing the orientation of the bottom closure panels of a second container blank and nesting the two blanks along the bottom closure panels. Now the blanks took the same amount of space as two of the normal style blanks, and the same number of blanks could be processed in the waxing facility. The inventors were able to provide a better bottom closure with no decrease in capacity in the waxing facility.

BRIEF DESCRIPTION OF THE DRAWINGS

FIG. 4 is a top plan view of the container blank made from the blank shown in FIG. 1.

DESCRIPTION OF THE PREFERRED EMBODIMENTS

Figure 1:
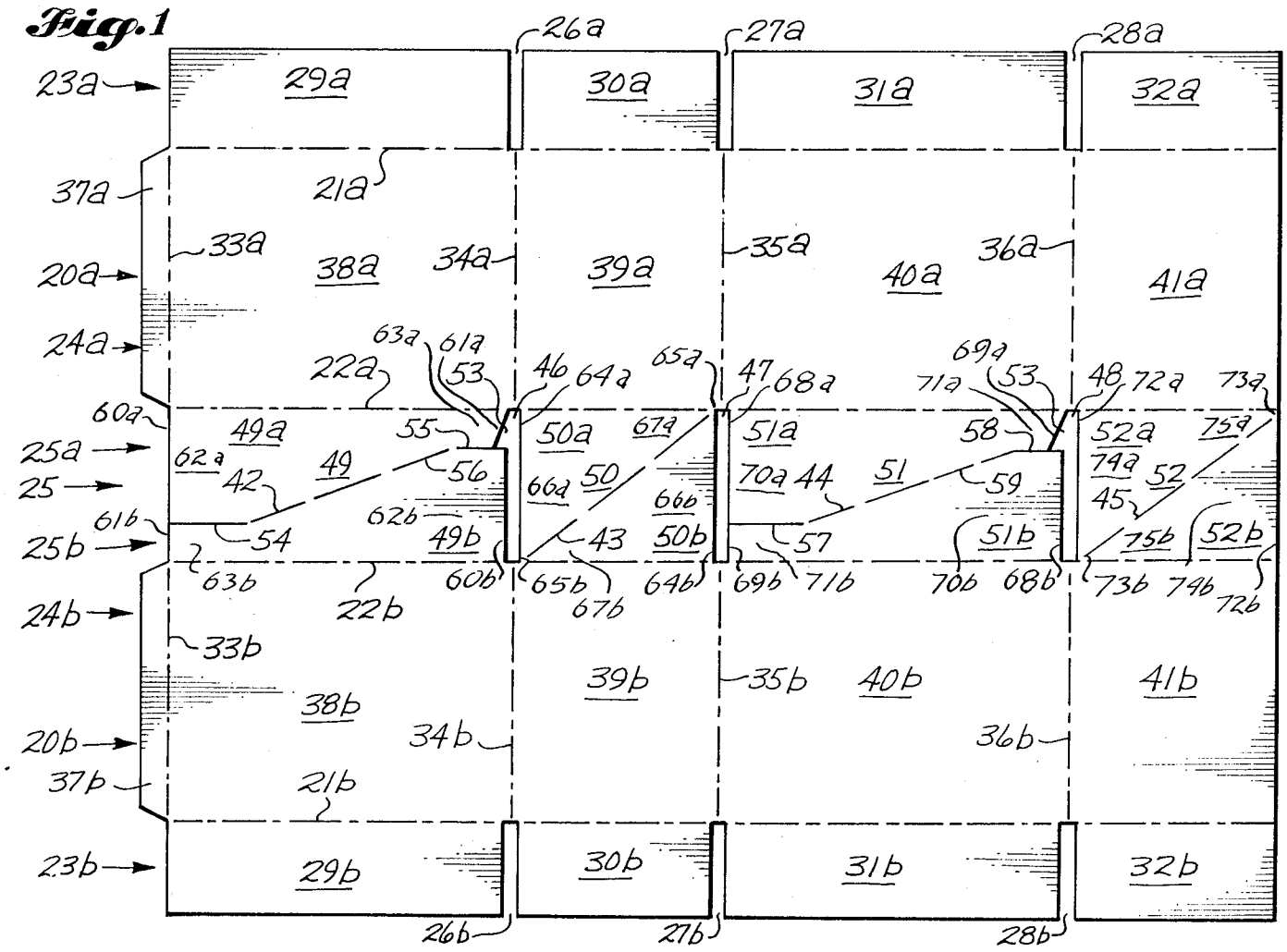
FIG. 1 is a top plan view of the nested two container blank in the form used for wax impregnation.

FIG. 1 shows a nested dual container blank 20 which includes the nested container blanks **20*a* and 20*b*. The blank 20 is divided by outer or upper longitudinal score lines 21*a* and 21*b* and inner or lower longitudinal score lines 22*a* and 22*b* into upper closure sections 23*a*** and 23*b*, side panel sections 24*a* and 24*b* and nested lower closure section 25.

The upper closure section 23*a* is divided by transverse slots 26*a*, 27*a* and 28*a* into a first major upper closure panel 29*a*, a first minor upper closure panel 30*a*, a second major upper closure panel 31*a* and a second minor upper closure panel 32*a*; and the upper closure section 23*b* is divided by transverse slots 26*b*, 27*b* and 28*b* into a first major upper closure panel 29*b*, a first minor upper closure panel 30*b*, a second major upper closure panel 31*b* and a second minor upper closure panel 32*b*.

The side panel section 24*a* is divided by transverse score lines 33*a*, 34*a*, 35*a* and 36*a* into a glue flap 37*a*, a first major side panel 38*a*, a first minor side panel 39*a*, a second major side panel 40*a*, and a second minor side panel 41*a*; and the side panel section 24*b* is divided by transverse score lines 33*b*, 34*b*, 35*b* and 36*b* into a glue flap 37*b*, a first major side panel 38*b*, a first minor side panel 39*b*, a second major side panel 40*b*, and a second minor side panel 41*b*. The score lines 33*a* and 33*b* are aligned with the outer side edges of major upper closure panels 29*a* and 29*b*; the score lines 34*a* and 34*b* are aligned with slots 26*a* and 26*b*; the score lines 35*a* and 35*b* are aligned with slots 27*a* and 27*b*; and the score lines 36*a* and 36*b* are aligned with slots 28*a* and 28*b*.

The nested lower closure section 25 is divided into separate lower closure sections 25*a* and 25*b* of the individual blanks 20*a* and 20*b* respectively by the skip-cuts 42, 43, 44 and 45. The distance between cuts in the skip-cuts 42, 43, 44 and 45 may vary from a 3/16 inch nick to a distance of ½ inch or greater. It will depend on the amount of corrugated board necessary to hold the two containers together during processing.

The nested lower closure section 25 is also divided into individual major and minor lower closure panel sections by the slots 46, 47 and 48. The slots 46, 47 and 48 divide the lower closure section 25 into a first major lower closure panel section 49, a first minor lower closure panel section 50, a second major lower closure panel section 51 and a second minor lower closure panel section 52. The slots 46, 47 and 48 are aligned with the score lines 34*a* and *b*, 35*a* and *b*, and 36*a* and *b*, respectively.

Certain of the slots 46, 47 and 48 are relieved as at 53 to allow easier separation of the two container blanks along the skip-cut lines.

The skip-cuts 42, 43, 44 and 45 divide each of these individual lower closure panel sections into a pair of lower closure panels. The skip-cut 42 divides the first major lower closure panel section 49 into the first major lower closure panel 49*a* of container blank 20*a* and the first major lower closure panel 49*b* of container blank 20*b*. The skip-cut 43 divides the first minor lower closure panel section 50 into the first minor lower closure panel 50*a* of container blank 20*a* and the first minor lower closure panel 50*b* of container blank 20*b*. The skip-cut 44 divides the second major lower closure panel section 51 into the second major lower closure panel 51*a* of container blank 20*a* and the second major lower closure panel 51*b* of container blank 20*b*. The skip-cut 45 divides the second minor lower closure panel section 52 into the second minor lower closure panel 52*a* of container blank 20*a* and the second minor lower closure panel 52*b* of container blank 20*b*.

The width of nested lower closure section 25, the width between the score lines 22*a* and 22*b*, will depend upon the spacing between the free outer edges 42 and 44 of the major closure flaps 49*a* and 51*a*. If the edges 42 and 44 abut to form a tight closure, then the width between score lines 22*a* and 22*b* will be equal to or substantially equal to the width of a minor side panel 39 or 41. If there is a space between the edges 42 and 44, then the width between score lines 22*a* and 22*b* will be less than the width of a minor side panel 39 or 47 and this width will depend upon the space between the edges 42 and 44 in the formed container. If the major bottom closure panels 49*a* and 51*a* overlap in the formed container, the width between score line 22*a* and 22*b* will be greater than the width of the minor side panels 39.

Figure 2:
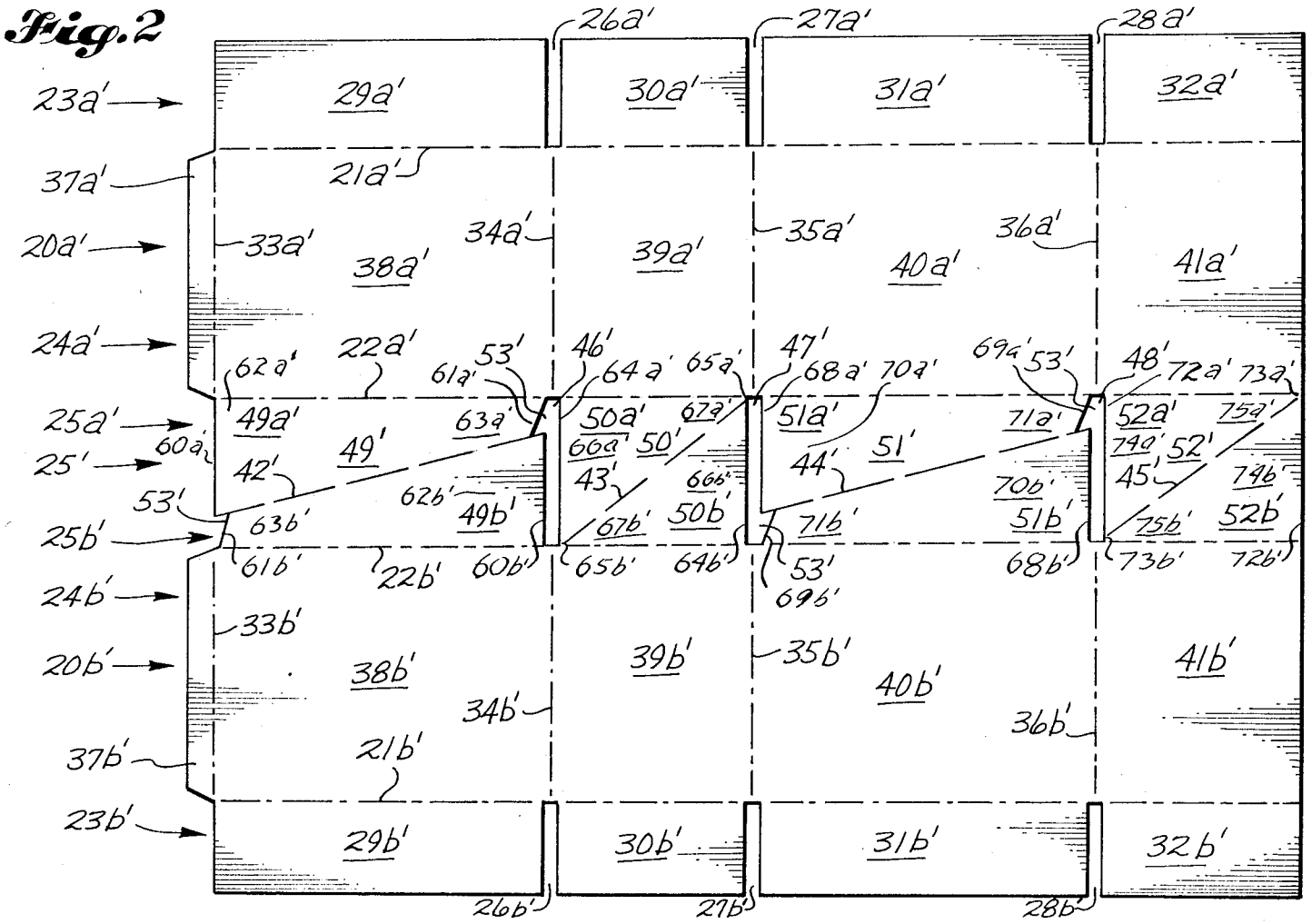
FIGS. 2–3 are top plan views of modified nested blanks.
Figure 3:
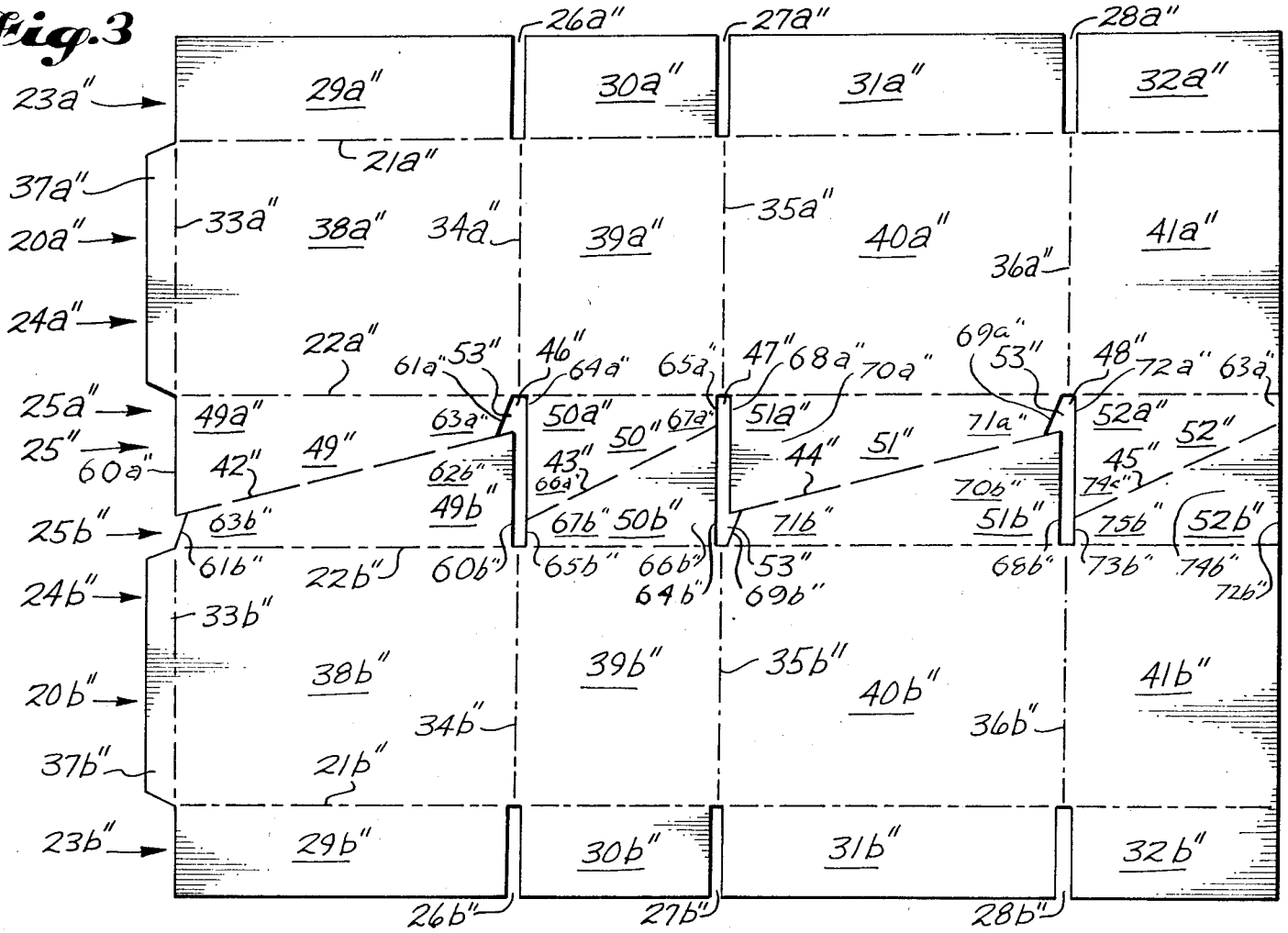
Figure 1:
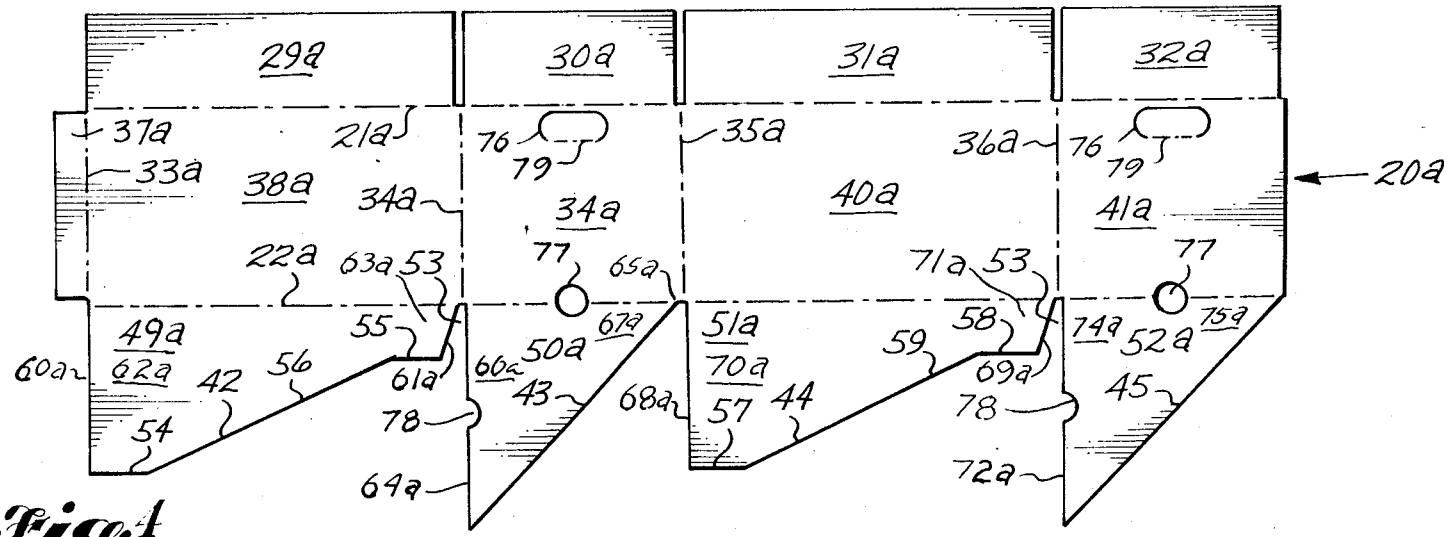

The oblique skip-cuts 42, 43, 44 and 45 may take a number of shapes. These are shown in FIGS. 1–3. In the blanks shown in FIGS. 1–3, the same reference numerals are used for the same parts.

In FIG. 1 the oblique skip-cuts 42 and 44 are each formed in three parts. In skip-cut 42, the first outer part 54 is spaced a slight distance from and is parallel to score line 22*b*, the second outer part 55 is spaced an equal distance from and is parallel to score line 22*a*. Each of these parts extend a short distance into the first major bottom closure panel section 49. In a container having a major dimension of about 20 inches and a minor dimension of about 12 inches, the parts 54 and 55 would each be spaced approximately 3 inches from its respective score line 22*b* or 22*a* and be approximately 3 inches long. Extending between the inner ends of the parts 54 and 55 is the oblique part 56. The skip-cut 44 in the second major bottom closure section 51 has the same configuration, the first and second outer parts 57 and 58 and the oblique part 59 extending between them. Their location and dimensions are as in major closure panel section 49. The skip-cuts 43 and 45 in the minor bottom closure panel sections 50 and 52 extend diagonally across the sections to form two triangular panels 50*a* and 50*b*, and 52*a* and 52*b*.

In FIG. 2 the skip-cuts 42′ and 44′ dividing the major bottom closure panel sections 49′ and 51′ are straight oblique lines extending across each section from a point approximately three inches from score line 22*a* on one end to a point approximately three inches from score line 22*b* at the opposite end. The skip-cuts 43′ and 45′ in the minor bottom closure panel section are the same as in FIG. 1.

The skip-cuts on the minor bottom closure panel sections may also be changed. This is shown in FIG. 3. The skip-cuts 43″ and 45″ form trapezoidal minor bottom closure panels 50*a*″, 50*b*″, 52*a*″ and 52*b*″.

The width between score lines 22*a*′ and 22*b*′, and between 22*a*″ and 22*b*″ is the same as between 22*a* and 22*b*. Again the width will depend upon whether there is a spacing between free edges 42′ and 44′ or 42″ and 44″, whether they abut in the formed container, or whether the major closure panels overlap.

The skip-cuts 42, 43, 44 and 45 in FIG. 1 and the corresponding skip-cuts in FIGS. 2–3 extend obliquely in the same direction. This allows the lower closure panels to interlock in the erect container.

The oblique skip-cuts 42, 43, 44 and 45 and the corresponding skip-cuts in FIGS. 2–3 create in each of the bottom closure panels a long section and a short section, the long section being adjacent the long side edge and the short section being adjacent the short side edge of each of the bottom closure panels. In FIG. 1, for example, in major bottom closure panel 49*a* the long side edge is 60*a* and the short side edge is 61*a*, and the long section is 62*a* and the short section is 63*a*. In major bottom closure panel 49*b* the long side edge is 60*b* and the short side edge is 61*b*, and the long section is 62*b* and the short section is 63*b*. In minor bottom closure panel 50*a* the long side edge is 64*a* and the short side edge is 65*a*, and the long section is 66*a* and the short section is 67*a*. In minor bottom closure panel 50*b* the long side edge is 64*b* and the short side edge is 65*b*, and the long section is 66*b* and the short section is 67*b*. In major bottom closure panel 51*a* the long side edge is 68*a* and the short side edge is 69*a*, and the long section is 70*a* and the short section is 71*a*. In major bottom closure panel 51*b* the long side edge is 68*b* and the short side edge is 69*b*, and the long section is 70*b* and the short section is 71*b*. In minor bottom closure panel 52*a* the long side edge is 72*a* and the short side edge is 73*a*, and the long section is 74*a* and the short section is 75*a*. In minor bottom closure panel 52*b* the long side edge is 72*b* and the short side edge is 73*b*, and the long section is 74*b* and the short section is 75*b*. In the construction shown in FIGS. 1 and 2 in which the skip-cuts 43 and 45 are diagonal, the short side edges 65*a*, 65*b*, 73*a* and 73*b* are for practical purposes nonexistent.

In any container blank all of the long side edges are on the same side of the blank and in the dual blank there is on any given side edge of a bottom closure section one long side edge and one short side edge as in bottom closure section 49 in which side edges 60*a* and 61*b* are on the same side edge.

FIG. 4 shows the blank 20*a* taken from the blank 20 of FIG. 1 and FIGS. 5–14 show the container being formed from this blank. This is exemplary of the containers that also may be formed from the blanks shown in FIGS. 1–3. The blank 20*a* is formed from blank 20 by separating the blank 20 into blank 20*a* and 20*b* along the skip-cuts 42, 43, 44 and 45. The lay-flat container is formed by bending the blank 20*a* around score lines 34*a* and 36*a* and adhering the glue flap 37*a* to the outer edge of the minor side panel 41*a*.

When the container is to be set up in the field, it is squared around the score lines 33*a*, 34*a*, 35*a* and 36*a* and the bottom closure panels are folded inwardly in sequence. The sequence is shown in FIGS. 6–11. The drawings show the sequence with the box top side up so the sequence will be described to conform to the drawings. In the field the box will be placed upside down to interlock the bottom closure flaps.

Figure 6:
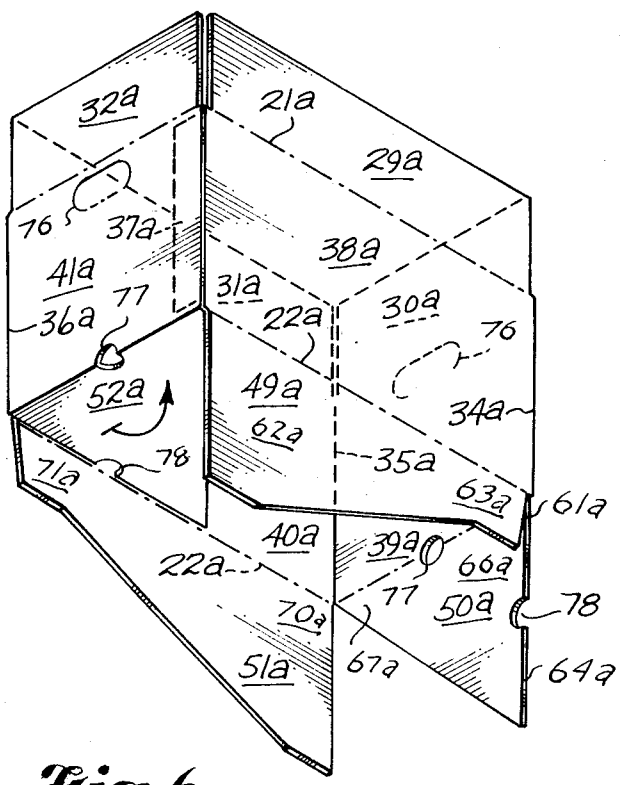
FIGS. 5–11 are isometric views showing the bottom closure of FIG. 4 being closed and interlocked.
Figure 5:
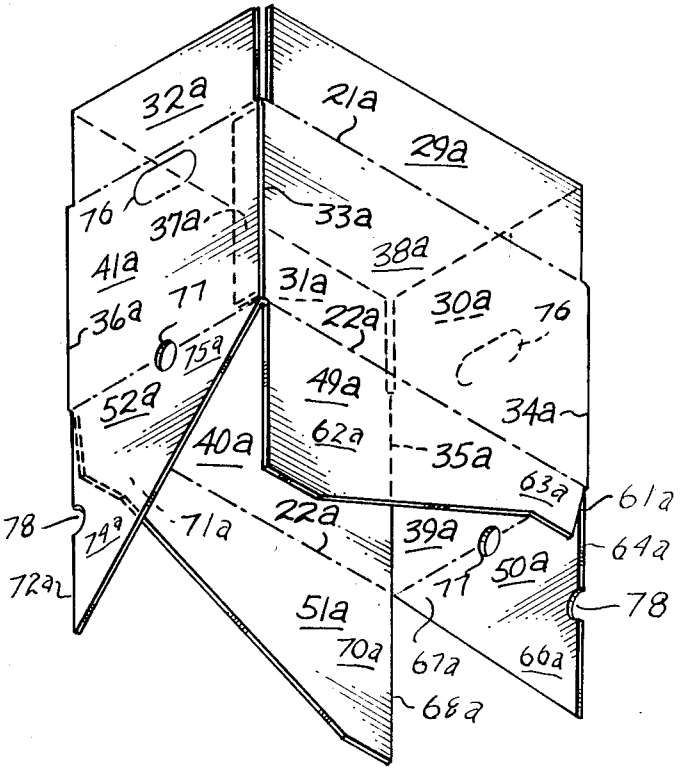
Figure 7:
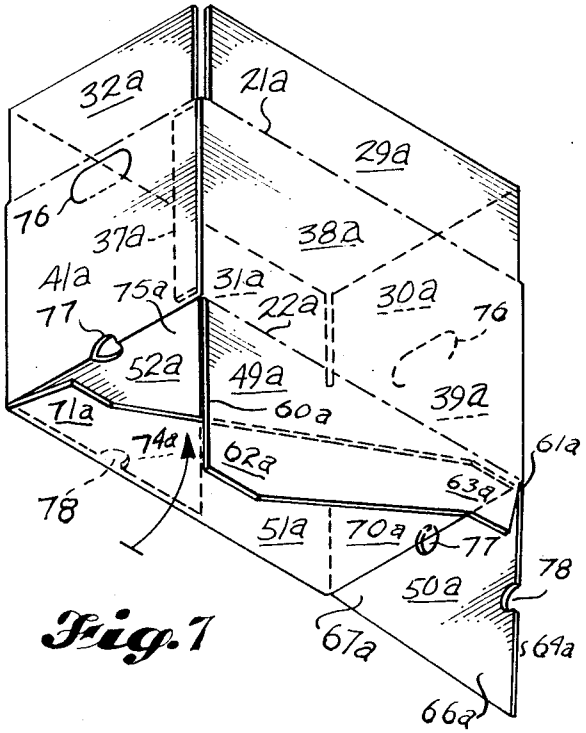

The first panel to be folded in is one of the minor bottom closure panels, in this case panel 52*a*. This is shown in FIG. 6. The next panel is the major lower closure panel 51*a*, the panel adjacent the long side edge 72*a* of panel 52*a*. This is shown in FIG. 7. The short section 71*a* of panel 51*a* is now under the long section 74*a* of panel 52*a*.

Figure 14:
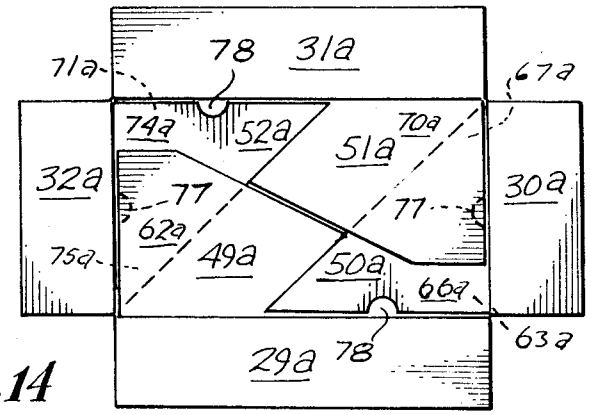
FIGS. 13 and 14 show the closed and interlocked configuration of the bottom closure panels, FIG. 13 being a bottom plan view and FIG. 14 being a top plan view.
Figure 13:
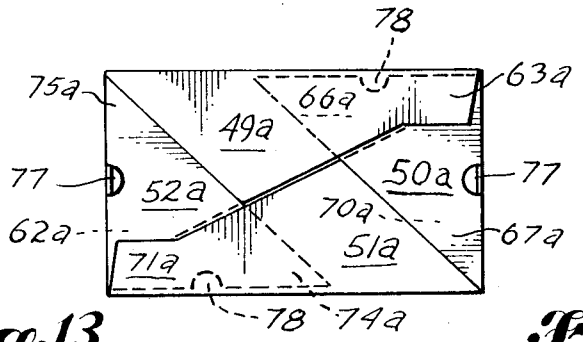
Figure 8:
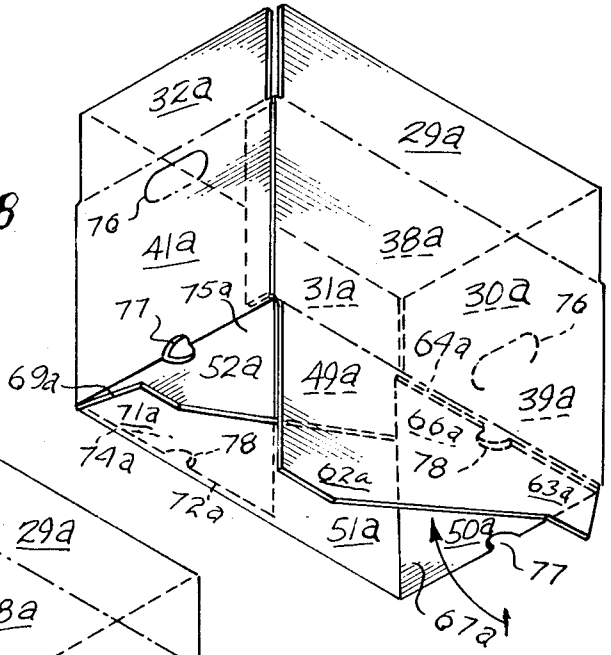
Figure 9:
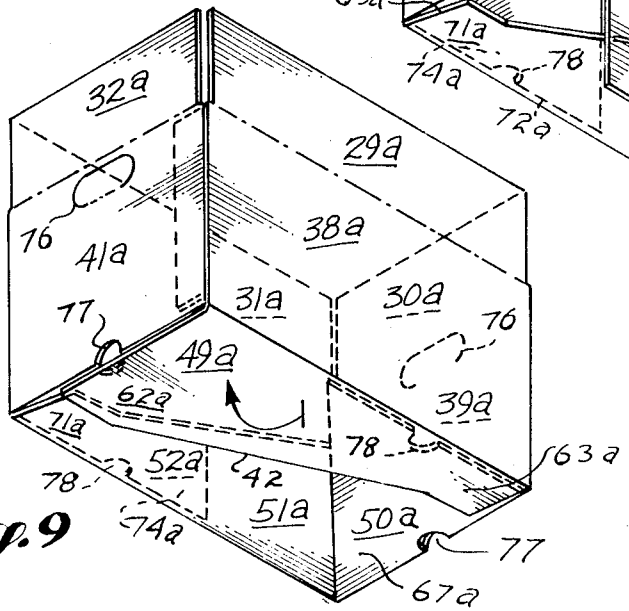
Figure 11:
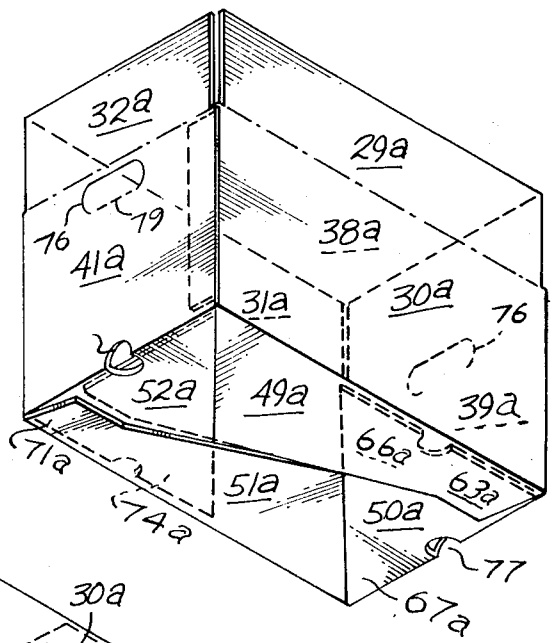
Figure 10:
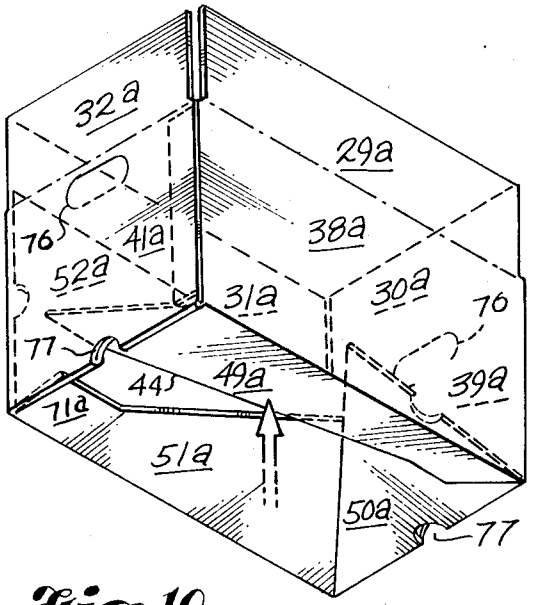

The other minor lower closure panel 50*a* is folded under the major lower closure panel 51*a*. This is shown in FIG. 8. The short section 67*a* of panel 50*a* is now under the long section 70*a* of panel 51*a*. Finally the other major lower closure panel 49*a* is folded under the others as shown in FIG. 9. The panel 49*a* is pushed into the container body as shown in FIG. 10. The oblique edge 42 of the panel 49*a* acts as a camming surface to force the other three bottom closure panels inwardly. When the long section 62*a* of panel 49*a* is behind panel 52*a*, then panel 50*a* forces the panel 49*a* back into the plane of the bottom closure to lock the four bottom closure panels together as shown in FIGS. 11, 13 and 14. The interlocked bottom closure panels are shown in FIGS. 13 and 14. The long section 62*a* of major bottom closure panel 49*a* is over the short section 75*a* of minor bottom closure panel 52*a*. The long section 74*a* of minor bottom closure panel 52*a* is over the short section 71*a* of major bottom closure panel 51*a*. The long section 70*a* of major bottom closure panel 51*a* is over the short section of 67*a* of minor lower closure panel 50*a*; and the long section 66*a* of minor lower closure panel 50*a* is over the short section 63*a* of major lower closure panel 49*a*.

Figure 12:
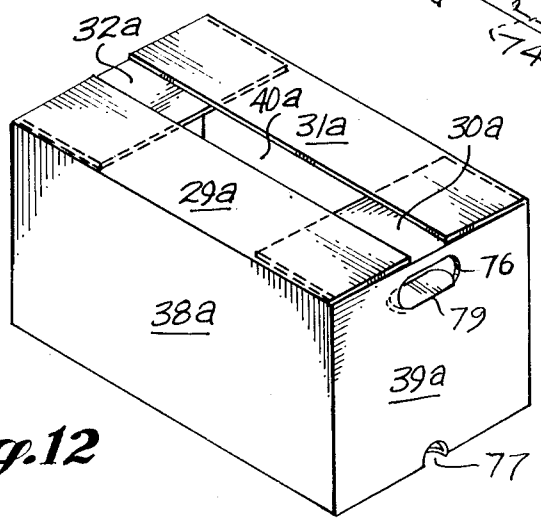
FIG. 12 is an isometric view showing the closed upper closure of the container.

After the container has been filled with produce the upper panels are closed and fastened in the usual manner. The minor upper closure flaps 30*a* and 32*a* are bent inwardly and the major upper closure flaps 29*a* and 31*a* are bent over and fastened to the minor upper closure flaps. This is shown in FIG. 12.

There are three additional features shown in the blank in FIG. 4. These are the handholds 76 in minor side panels 39*a* and 41*a*; the air holes 77 which straddle score line 22*a*; and the finger holds 78 in the side edges 64*a* and 72*a* of bottom closure panels 50*a* and 52*a*, respectively. These are exemplary of the types of features that can be placed in the container.

The hand holds 76 are shown as hinged along their lower edge at score line 79. The air holes 77 are shown in both the lower edge of the minor side panels 39*a* and 41*a* and the hinged edge of the bottom panels 50*a* and 52*a*. They can, however, be placed in any convenient location in the container. The finger apertures 78 allow the lower closure panels 50*a* and 52*a* to be pulled upwardly to release the interlocked lower closure panels in the erect container. This allows the container to be placed in lay-flat condition again after it has been used.

In some constructions, the upper closure flaps 23*a* and 23*b* may be eliminated and a telescoping cover may be substituted.

The free edges of the major bottom closure panels will abut if the product within the container is being iced and it is desired to retain the ice within the container. In this case, drain holes will be placed in the side panels at or near the bottom of the panel.

We claim:

1. A blank for a pair of nested containers comprising a pair of side panel sections, each said side panel section being divided by transverse score lines into four side panels, two of said side panels forming opposing major side panels in the erect container and the other two of said side panels forming opposing minor side panels in the erect container, and a glue flap attached to the outer edge of one of said outer side wall panels along a score line;

a bottom closure section extending between said side panel sections, said bottom closure section being defined by longitudinal score lines, slots extending across said bottom closure section between said transverse score lines, said slots dividing said bottom closure panel section into separate bottom closure panel sections, said bottom closure panel sections associated with said major side panels being major bottom closure panel sections and said bottom closure panel sections associated with said minor side panels being minor bottom closure panel sections;

each of said major and minor bottom panel closure sections being divided by skip-cuts into major and minor bottom closure panels, said skip-cuts defining outer edges of said major and minor bottom closure panels;

each of said skip-cuts having at least a section extending obliquely across a portion of each bottom panel section, each of said oblique skip-cuts extending in the same oblique direction, and said separate major and minor bottom closure panels of a container being interlockable in the erect container whereby each of said bottom closure panels is over one adjacent bottom closure panel and under the other adjacent bottom closure panel to lock said bottom closure panels in position in the erect container, said outer edges of said bottom closure panels providing camming surfaces which allow the last placed bottom closure panel to move over one adjacent bottom closure panel and under said other adjacent bottom closure panel during inward movement of said last placed bottom closure panel in the formation of the erect container.

2. The blank of claim 1 in which the skip-cuts in said minor bottom closure panel sections extend diagonally across said minor bottom closure panel sections and are parallel to each other.

3. The blank of claim 1 in which the skip-cuts in said minor bottom closure panel sections extend obliquely across said minor bottom closure panel sections between points on the side edges of said minor bottom closure panel sections, one of said points being spaced a first distance from one of said longitudinal score lines and the other of said points being spaced an equal distance from the other of said longitudinal score lines, said skip-cuts in said minor bottom closure panel sections being parallel.

4. The blank of claim 1 in which said skip-cuts in said major bottom closure panel sections extend obliquely across said major bottom closure panel sections between points on the side edges of said major bottom closure panel section, one of said points being spaced a first distance from one of said longitudinal score lines and the other of said points being spaced an equal distance from the other of said longitudinal score lines, said skip-cuts in said major bottom closure panel sections being parallel.

5. The blank of claim 1 in which the skip-cuts in said major bottom closure panel sections are each in three parts, the two outer parts adjacent the side edges of said major bottom closure panel sections being parallel to said longitudinal score lines, one of said two outer parts being spaced from one of said longitudinal score lines and the other of said two outer parts being spaced an equal distance from the other of said longitudinal score lines, said outer parts being of equal length, and a central oblique part extending between the inner ends of said outer parts.

6. A blank for a container comprising a side panel section divided by transverse score lines into four side panels, two of said side panels forming opposing major side panels in the erect container and the other two of said side panels forming opposing minor side panels in the erect container, and a glue flap attached to the outer edge of one of said outer side wall panels along a score line;

bottom closure panels attached by a score line to the lower edge of each of said side wall panels, said bottom closure panels associated with said major side panels being major bottom closure panels and said bottom closure panels associated with said minor side panels being minor bottom closure panels, each of said bottom closure panels having an outer edge which extends obliquely across said panel, each of said oblique outer edges extending in the same oblique direction, said oblique outer edges of said bottom closure panels defining long and short side edges on each of said bottom closure panels, said separate major and minor bottom closure panels being interlockable in the erect container whereby each of said bottom closure panels is over one adjacent bottom closure panel and under the other adjacent bottom closure panel to lock said bottom closure panels in position in the erect container, said outer edges of said bottom closure panels providing camming surfaces which allow the last placed bottom closure panel to move over one adjacent bottom closure panel and under said other adjacent bottom closure panel during inward movement of said last placed bottom closure panel in the formation of the erect container.

7. The blank of claim 6 in which said oblique outer edges of said minor bottom closure panels extend diagonally across said minor bottom closure panels and are parallel to each other.

8. The blank of claim 6 in which said oblique outer edges of said minor bottom closure panels extend between points on the side edges of said minor bottom closure panels, one of said points being spaced a first distance from said score line attachment to said side panels and the other of said points being spaced a second distance from said score line attachment to said side panels, said oblique edges of said minor bottom closure panels being parallel to each other.

9. The blank of claim 6 in which said oblique outer edges of said major bottom closure panels extend between points on the side edges of said major bottom closure panels, one of said points being spaced a first distance from said score line attachment to said side panels and the other of said points being spaced a second distance from said score line attachment to said side panels, said oblique edges of said major bottom closure panels being parallel to each other.

10. The blank of claim 6 in which said oblique outer edges of said major bottom closure panels are each in three parts, the two outer parts adjacent the side edges of said major bottom closure panels being parallel to said score line attachment to said side panels, one of said outer parts being spaced from said score line attachment to said side panels further than the other of said outer parts, said outer parts being of equal length, and a central oblique part extending between the inner edges of said outer parts.

11. A container comprising two opposed major side walls, and two opposed minor side walls, said major and minor side walls being hingedly joined to each other, bottom closure flaps hingedly to the lower edge of each of said side walls, said bottom closure panels associated with said major side panels being major bottom closure panels and said bottom closure panels associated with said minor side panels being minor bottom closure panels, each of said bottom closure panels having an outer edge which extends obliquely across said panel, said oblique outer edges of said bottom closure panels defining long and short side edges on each of said bottom closure panels, each of said long side edges of each of said bottom closure panels being on the same clockwise side of each of said bottom panels, each of said bottom closure panels having a long section adjacent said long side edge and a short section adjacent said short side edge, said separate major and minor bottom closure panels closing said bottom of said container and being interlocked, the long section of one of said major bottom closure panels being over the short section of the adjacent minor bottom closure panel, the long section of said adjacent minor closure panel being over the short section of the other of said major bottom closure panels, the long section of said other major bottom closure panel being over the short section of the other of said minor bottom closure panels, the long section of said other minor bottom closure panel being over the short section of said one major bottom closure panel, the oblique edges of said minor bottom closure panels being parallel and said oblique edges of said major bottom closure panels being substantially congruent, said outer edges of said bottom closure panels providing camming surfaces which allow the last placed bottom closure panel to move over one adjacent bottom closure panel and under said other adjacent bottom closure panel during inward movement of said last placed bottom closure panel in the formation of the erect container.

12. The container of claim 11 in which said oblique outer edges of said minor bottom closure panels extend diagonally across said minor bottom closure panels.

13. The container of claim 11 in which said oblique outer edges of said minor bottom closure panels extend between points on the side edges of said minor bottom closure panels, one of said points being spaced from said score line attachment to said side panels further than the other of said points.

14. The container of claim 11 in which said oblique outer edges of said major bottom closure panels extend between points on the side edges of said major bottom closure panels, one of said points being spaced from said score line attachment to said side panels further than the other of said points.

15. The container of claim 11 in which said oblique outer edges of said major bottom closure panels are each in three parts, the two outer parts adjacent the side edges of said major bottom closure panels being parallel to said score line attachment to said side panels, one of said outer parts being spaced from said score line attachment to said panels further than the other of said outer parts, said outer parts being of equal length and a central oblique part extending between the inner edges of said outer parts.

* * * * *